US006555979B2

(12) United States Patent
Arnold et al.

(10) Patent No.: US 6,555,979 B2
(45) Date of Patent: Apr. 29, 2003

(54) SYSTEM AND METHOD FOR CONTROLLING ELECTRICAL CURRENT FLOW AS A FUNCTION OF DETECTED SOUND VOLUME

(76) Inventors: L. Taylor Arnold, 5015 Dunwoody Trail, Raleigh, NC (US) 27606-1726; Richard Michelli, 3925-C Knickerbocker Pkwy., Raleigh, NC (US) 27612

( * ) Notice: Subject to any disclaimer, the term of this patent is extended or adjusted under 35 U.S.C. 154(b) by 80 days.

(21) Appl. No.: 09/730,046

(22) Filed: Dec. 6, 2000

(65) Prior Publication Data

US 2002/0125844 A1 Sep. 12, 2002

(51) Int. Cl.[7] ..... A63H 29/22; A63H 30/04

(52) U.S. Cl. ..... 318/272; 318/16; 318/460; 446/175; 446/213

(58) Field of Search ..... 318/16, 268, 272, 318/460, 480; 446/7, 93, 175, 213, 297, 397, 484, 491; 388/933

(56) References Cited

U.S. PATENT DOCUMENTS 2,888,055 A * 1/1959 Simos
3,795,064 A * 3/1974 Sims-Williams
4,165,581 A * 8/1979 Wolf
4,224,762 A * 9/1980 McCaslin
4,245,430 A * 1/1981 Hoyt
4,322,718 A * 3/1982 Faierstain
4,673,371 A * 6/1987 Furukawa
4,795,395 A * 1/1989 Oishi et al. ..... 446/175
4,850,930 A * 7/1989 Sato et al. ..... 446/175
4,903,424 A 2/1990 Satoh et al. ..... 40/414
5,085,610 A * 2/1992 Engel et al.
5,324,225 A 6/1994 Satoh et al. ..... 446/175
5,402,702 A 4/1995 Hata ..... 84/464
5,407,376 A * 4/1995 Avital et al. ..... 446/175
5,647,787 A 7/1997 Raviv et al. ..... 446/175
5,720,644 A 2/1998 Ku ..... 446/175
6,089,942 A * 7/2000 Chan
6,177,775 B1 * 1/2001 Bruington et al.
6,358,111 B1 * 3/2002 Fong et al. ..... 446/297
6,384,550 B1 * 5/2002 Miyakawa et al. ..... 318/116
6,457,681 B1 * 10/2002 Wolf et al.

* cited by examiner

*Primary Examiner*—Bentsu Ro
(74) *Attorney, Agent, or Firm*—LaMorte & Associates

(57) ABSTRACT

A system and method for selectively controlling an electrical component is claimed. The system contains an audio detector, such as a microphone, that receives sound energy and converts the sound energy into a corresponding electrical signal. The content of the sound energy is irrelevant. Rather, it is the volume of the sound energy that is to be represented by the electrical signal. To produce an electrical signal that corresponds to noise volume, the amplitude of the electrical signal is amplified. The amplified signal is then rectified and filtered, thereby producing a D/C electrical signal that is representative of the volume of the sound energy detected. The D/C electrical signal is used to selectively regulate a current flow controller. The current flow controller controls the flow of current to the electronic component.

18 Claims, 4 Drawing Sheets

SYSTEM AND METHOD FOR CONTROLLING ELECTRICAL CURRENT FLOW AS A FUNCTION OF DETECTED SOUND VOLUME

BACKGROUND OF THE INVENTION

1. Field of the Invention

In general, the present invention relates to devices that are activated and/or controlled by sound energy. More particularly, the present invention relates to devices that are activated and/or controlled by sound energy and are sensitive to the volume of the sound energy detected.

2. Description of the Prior Art

The are many commercial devices in existence that are activated or controlled by sound energy. In the security industry, there are many sensors that detect sound, wherein the detected sound is used to activate alarms. In the field of consumer products, there exist many different sound activated switch controls that can activate or deactivate any electrical device that plugs into a wall receptacle. With such devices, a person can turn on or off a television or light by clapping or making some other loud sound. However, the field in which most consumers would encounter a sound controlled device, is the field of novelty items, such as toys and games.

In the field of toys and games there exist many different novelty items that are activated or controlled by sound energy. Typically, such novelty items contain a microphone that is coupled to a threshold comparator. If a sound is detected that exceeds a predetermined threshold, the device is either activated or deactivated. Such sound controlled devices are exemplified by U.S. Pat. No. 4,903,424, to Satoh, entitled Movable Decoration; U.S. Pat. No. 5,324,225 to Satoh, entitled Interactive Toy Figure With Sound Activated And Pressure Activated Switches; and U.S. Pat. No. 5,720,644 to Ku, entitled Voice Activated Spherical Tumbler. In such prior art devices, the devices are activated once the level of detected sound energy surpasses a predetermined threshold. The device stops after a predetermined period of time or when the received sound energy falls back below the predetermined threshold. In these prior art devices, the volume of the sound, once it passes the activation threshold, is irrelevant to the operation of the devices.

Other novelty devices exist that are activated by the content of detected sound rather than by the mere presence of sound. For example, U.S. Pat. No. 5,647,787 to Raviv, entitled Sound Controlled Toy, detects voice commands and compares those commands to commands stored in a memory. If a received voice command matches that of a command stored in memory, the device performs a function unique to that command. Another example is shown by U.S. Pat. No. 5,402,702 to Hata, entitled Trigger Circuit Unit For Operating Light Emitting Members Such As LEDs Or Motors For Use In Personal Ornament Or Toy In Synchronization With Music. In the Hata patent, sound energy is analyzed to detect the base rhythm of the music or the voice component to the music. Lights or motors are then activated in response to rhythm changes in the detected component of the sound. As such, control is dependent upon the content of the sound energy rather than by the volume of the sound energy.

The present invention is a system that controls current flow to an electrical component, such as a variable speed motor. The selective control of the current flow is made a function of the volume of detected sound energy, not a function of the content of the sound energy. The greater the volume of the sound energy detected, the greater the flow of current and the faster the variable speed motor will run. Conversely, the lower the volume of sound energy detected, the slower the variable speed motor will run. Such a system, when applied to toys and other novelty items, adds greatly to the play value of such toys. This is because a child is encouraged to cheer or make as much noise as possible in order to activate the novelty device to its greatest extent. The novelty and functionality of the present invention system are described and claimed below.

SUMMARY OF THE INVENTION

The present invention is a system and method for selectively controlling an electrical component, such as a variable speed motor, in response to the volume of detected sound energy. The system contains an audio detector, such as a microphone, that receives sound energy and converts the sound energy into a corresponding electrical signal. The content of the sound energy is irrelevant. Rather, it is the volume of the sound energy that is to be represented by the electrical signal. To produce an electrical signal that corresponds to noise volume, the amplitude of the electrical signal is amplified. The amplified signal is then rectified and filtered, thereby producing a D/C electrical signal that is representative of the volume of the sound energy detected. The D/C electrical signal is used to selectively regulate a current flow controller. The current flow controller controls the flow of current to the electrical component. As such, the current flow to the electrical component is made to be directly proportional to the volume of detected sound energy.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention system and method can be used to control the flow of current to any electrical component as a function of received sound volume, the present invention system and method are especially well suited for controlling novelty items, such as toys. As such, by way of example, some of the embodiments of the present invention system and method are configured as toys. Such a choice of configurations should not be considered limitations of the possible applications for the present invention system and method. Rather, such embodiments are presented merely as the best contemplated modes for utilizing the present invention system and method.

Figure 1:
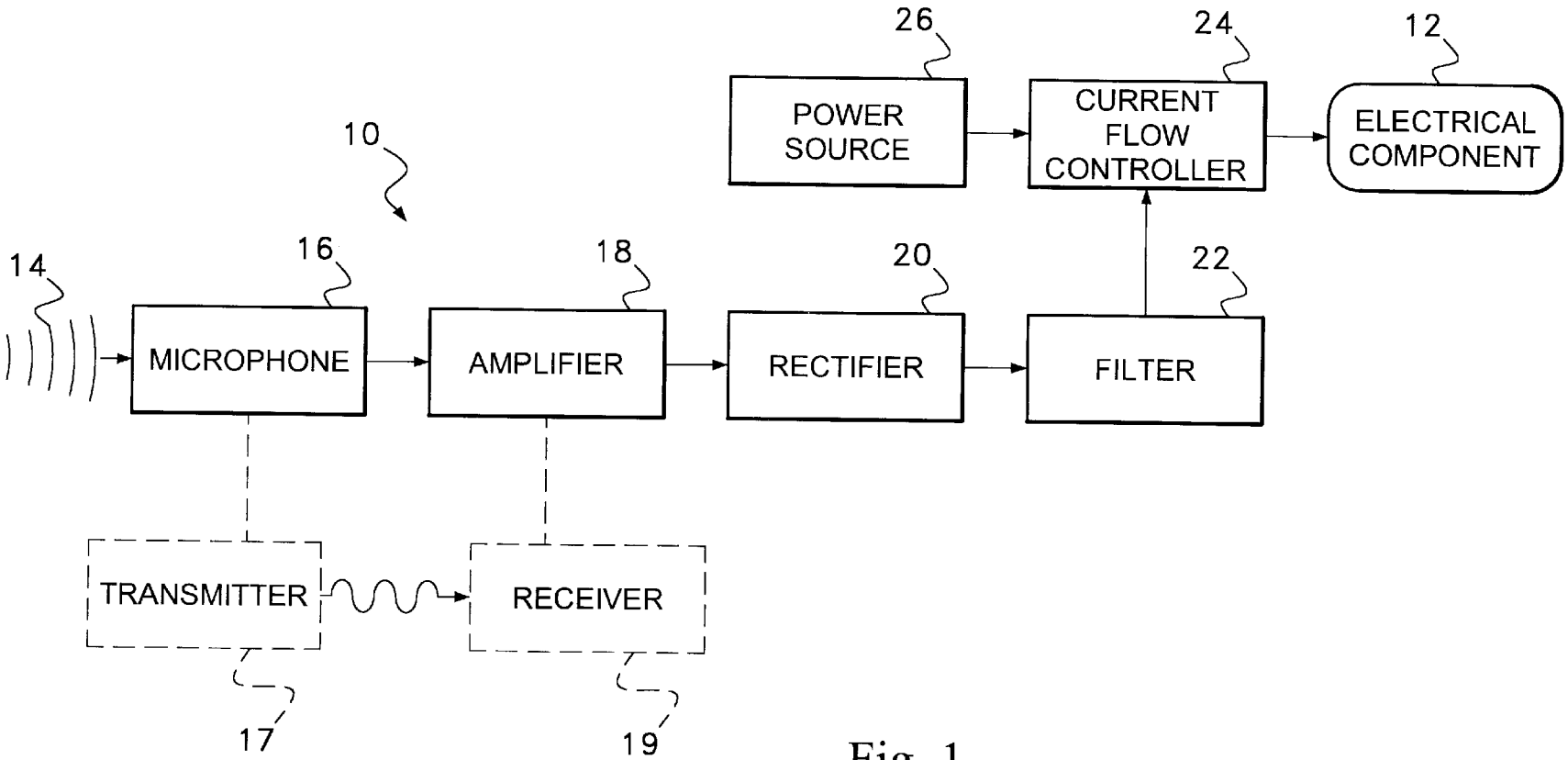
FIG. 1 is an exemplary block diagram schematic of the present invention system in accordance with the present invention.

Referring to FIG. 1, a schematic of the present invention system 10 is shown. The purpose of the system 10 is to selectively control the flow of current to an electrical component 12 in direct proportion to the volume of sound energy 14 received by a microphone 16. The electrical component 12 can be a variable speed motor, light or any other component that requires electricity to function. As such, the louder the volume of sound energy 14 that is detected by the microphone 16, the greater the flow of current to the electrical component 12.

From FIG. 1, it can be seen that the microphone 16 detects sound energy 14 and converts the sound energy into an electrical A/C signal. The A/C signal is amplified by an operational amplifier 18, which amplifies the amplitude of the A/C signal. The amplified A/C signal passes through a rectifier 20 that rectifies the A/C signal, thereby creating a D/C signal. The rectified D/C signal is passed through a filter 22 and is then directed to the control input of a current flow controller 24. Depending upon the signal received by the current flow controller 24, the current flow controller 24 selectively controls the current flow between the electrical component 12 and a power source 26. The current flow controller 24 is arranged so that it increases current flow in proportion to the strength of the received D/C signal.

Figure 2:
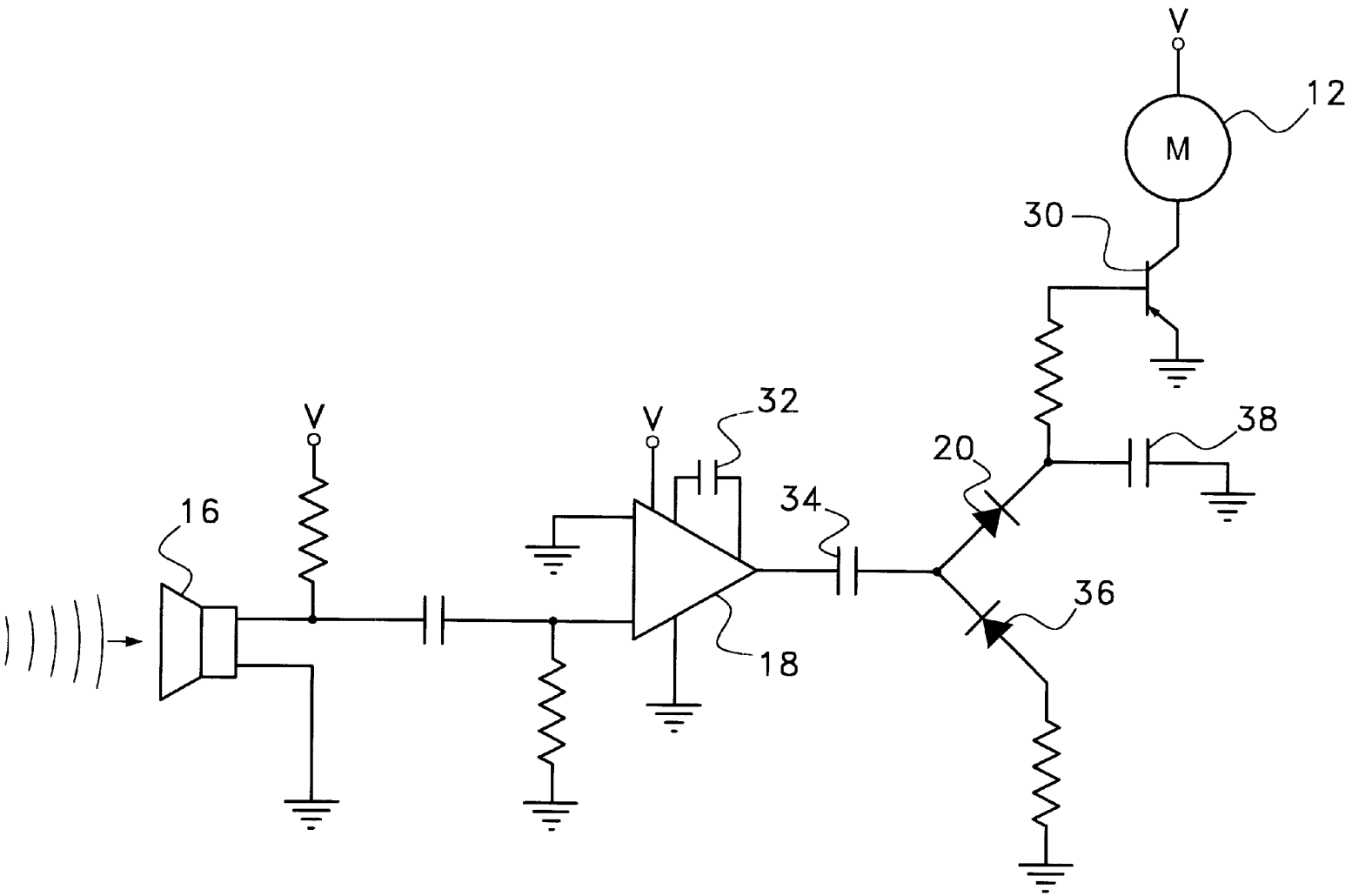
FIG. 2 is an exemplary circuit schematic of a circuit capable of operating in accordance with the present invention system.

Referring to FIG. 2, an exemplary circuit is shown that performs the functions of the schematic described in relation to FIG. 1. Elements of the circuit in FIG. 2 that correspond to the block elements in the schematic of FIG. 1 are identified with the same reference numerals. In FIG. 2, it can be seen that the output of a microphone 16 is connected to the input of an operational amplifier 18. In the shown embodiment, the operational amplifier 18 is a LM386 amplifier having its first and eighth pin coupled to opposite sides of a first capacitor 32. The operational amplifier 18 in the configuration shown amplifies the amplitude of the signal produced by the microphone 16.

The output of the operational amplifier 18 is coupled to the anode side of a second capacitor 34. The cathode side of the second capacitor 34 leads to a rectifier 20. The rectifier 20 alters the A/C output of the operational amplifier 18 and produces a D/C signal. A balancing diode 36 is also connected to the second capacitor 34 to prevent a D/C offset.

Using a third capacitor 38 that is coupled to ground, the D/C signal exiting the rectifier 20 is filtered. This produces a smoother waveform in the D/C signal. The filtered D/C signal is then coupled to the gate of a transistor 30. The transistor 30 is placed in series with the electrical component 12 and the power source, so as to control the flow of current through the electrical component 12. The transistor 30 is operated in a linear mode, wherein the current flow permitted between the source and drain of the transistor 30 is dependent upon the control signal received at the gate of the transistor. Accordingly, the amount of current enabled to flow through the transistor 30 is directly proportional to the D/C signal received at the gate of the transistor 30.

The electrical component 12 can be a variable speed motor, a light or any other electrical assembly that operates throughout a predetermined range of current flow. The electrical component 12, however, is part of a larger assembly, such as a toy, animated object, vibrating mechanism or the like.

Figure 3:
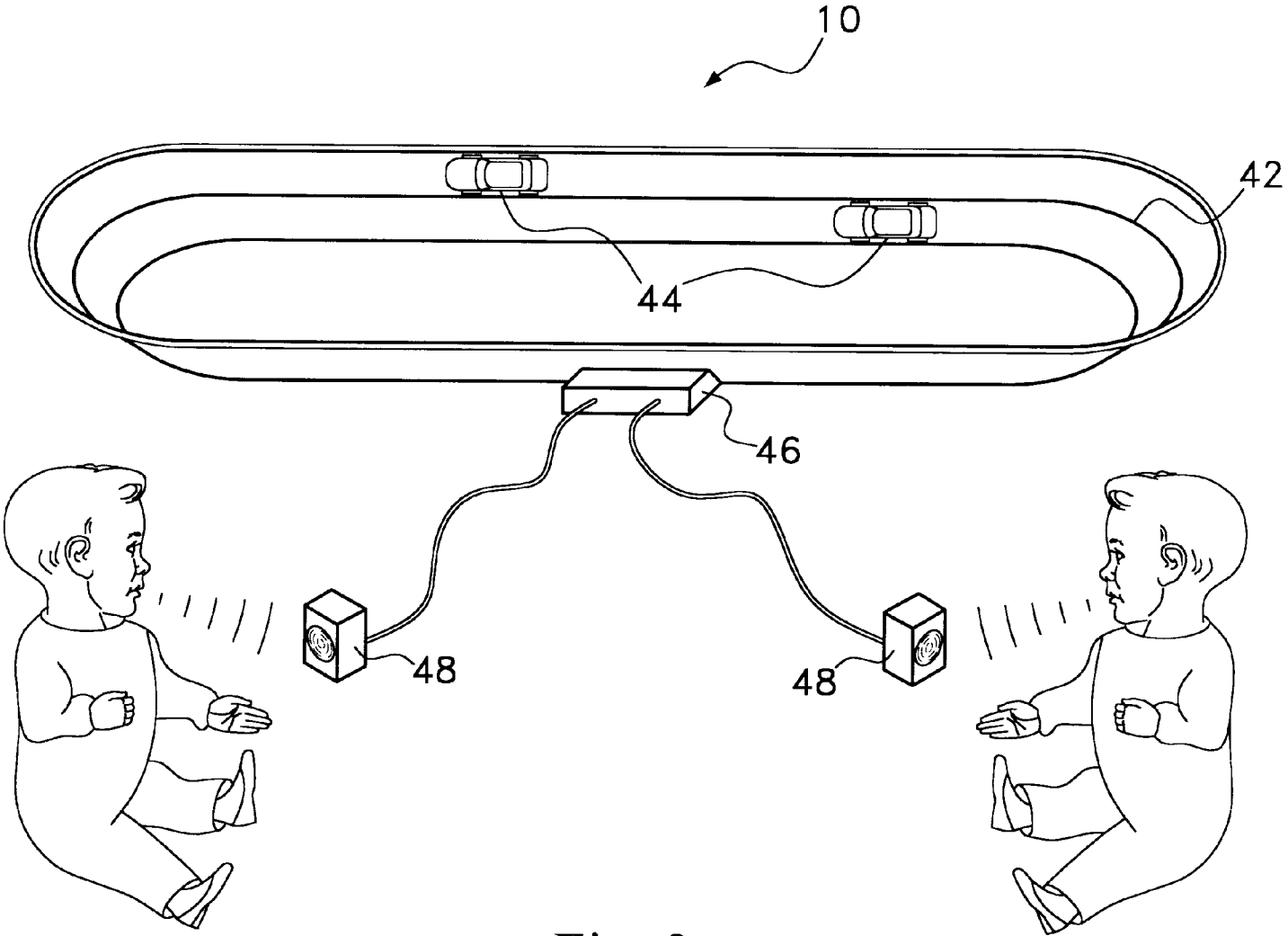
FIG. 3 is perspective view of a slotted racing car track in accordance with the present invention.

Referring to FIG. 3, a slot car racing set 40 is shown that embodies the present invention system. The slot car racing set 40 has a slotted track 42 around which electric cars 44 race. The electric cars 44 contain variable speed motors and are powered by conductive strips that are present in the track 42. Current to the track 42 is governed by a control box 46 that is positioned adjacent the track 42. The control box 46 contains the present invention system previously described. Microphones 48 extend from the control box 46. Each player uses one of the microphones 48 to control one of the electric cars 44 on the track 42. The more noise a player makes in the microphone 48, the more current will be directed into that player's track and the faster that player's car 44 will go. As such, in order to make a car 44 go as fast as is possible, a player must direct as much noise as is possible into the microphone 48. This adds directly to the play value of the toy.

Referring briefly back to FIG. 1, it can be seen that an optional transmitter 17 is shown that is attached to the microphone 16. An optional receiver 19 is also shown attached to the amplifier 18. If the transmitter 17 and receiver 19 are used, there does not have to be any direct physical interconnection between the microphone 16 and the remainder of the system 10. Rather, the sound energy received by the microphone 16 can be transmitted to the remainder of the system 10 using radio waves, microwaves or infrared transmissions.

Figure 4:
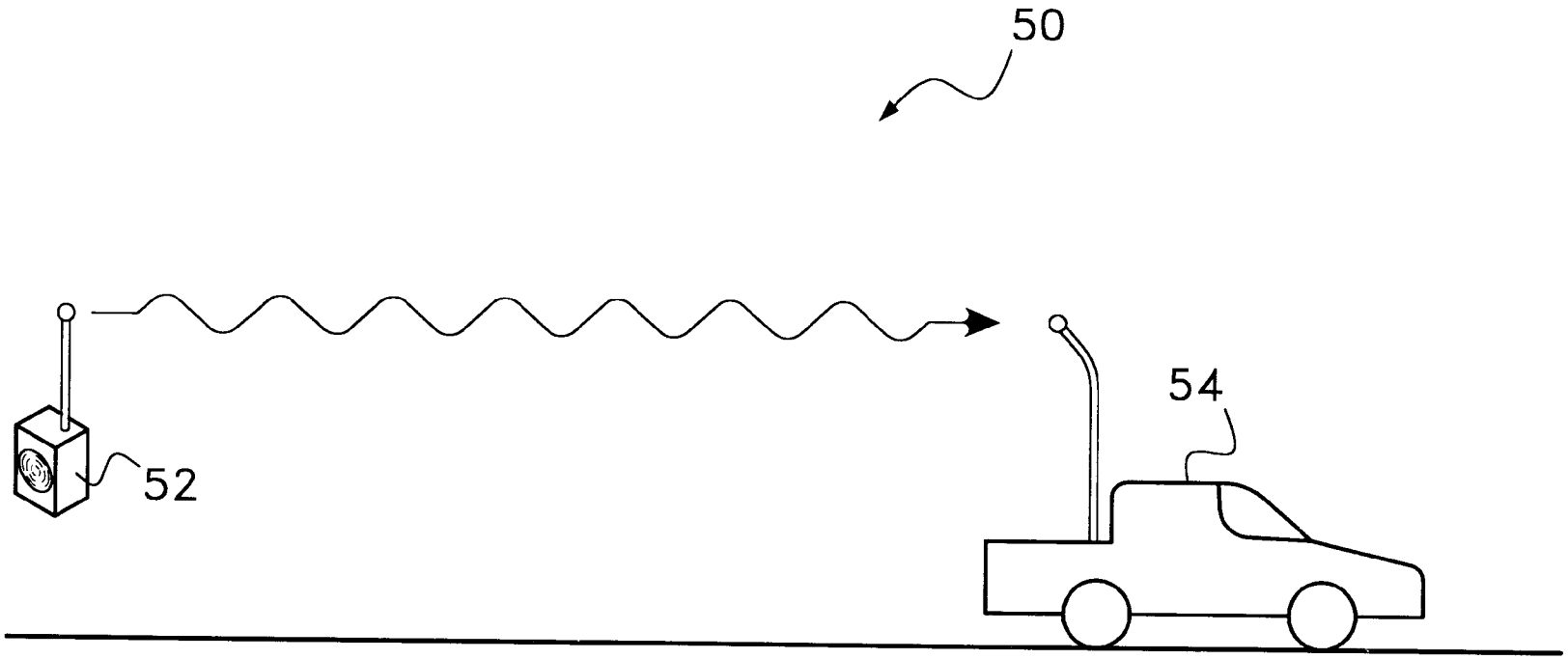
FIG. 4 is a side view of a toy car operated remotely with a control system that utilizes the present invention.

Referring now to FIG. 4, a system 50 that uses a remote microphone handset 52 is shown. In this embodiment, the microphone is contained in a portable handset 52. The remainder of the system 10 (FIG. 1) is contained in a separate novelty item 54, such as a toy. In FIG. 4, the toy is again a car. As such, the more noise a person makes into the handset 52, the faster the car will travel.

It will be understood that the embodiments of the present invention described and illustrated herein are merely exemplary and a person skilled in the art can make many variations to the embodiments shown without departing from the scope of the present invention. For example, there are many different amplifier circuits, rectifier circuits and current flow controllers that can be used in the present invention other than the specific circuitry contained in the embodiment of FIG. 2. Furthermore, the present invention system can be used to control more than toy cars. The system can control any electrical item that utilizes a selectively variable current flow. For example, the present invention system can be used to control lights, animated toys, vibrating items, and the like. All such variations, modifications and alternate embodiments are intended to be included within the scope of the present invention as defined by the appended claims.

What is claimed is:

1. A system comprising:

a toy vehicle containing a variable speed motor that propels said vehicle at a speed proportional to a flow of current received by said variable speed motor;

a power source for providing a flow of current;

a microphone for detecting sound energy and converting the sound energy into a corresponding electrical signal, wherein said electrical signal varies in proportion to the volume of the sound energy detected; and a current flow controller for selectively controlling the flow of current from the power source to said variable speed motor as a function of said electrical signal, wherein the louder the volume of sound received by said microphone, the more current said current flow controller enables between said power source and said variable speed motor and the faster the toy vehicle moves.

2. The system according to claim 1, further including an amplifier disposed between said microphone and said current flow controller for amplifying the electrical signal produced by the microphone.

3. The system according to claim 2, wherein said electrical signal produced by said microphone is an alternating current signal, and said system includes a rectifier disposed between said amplifier and said current flow controller for converting the electrical signal into a direct current signal.

4. The system according to claim 3, further including a filter for filtering said direct current signal.

5. The system according to claim 1, wherein said current flow controller is a transistor, wherein said electrical signal is received by the gate of the transistor.

6. The system according to claim 1, further including a transmitter coupled to said microphone and a receiver coupled to said current flow controller, wherein said electrical signal is passed between said transmitter and said receiver by a remote link.

7. An assembly comprising:

a variable speed motor capable of rotating at different speeds, wherein the rotational speed of said motor depends upon current supplied to said motor;

a vehicle propelled by said variable speed motor, wherein said vehicle travels at a speed dependent upon said rotational speed of said motor;

an audio detector for detecting the volume of sound energy at a particular location and producing an electrical signal corresponding to the volume of sound energy;

a current flow controller for selectively controlling current flow to said motor as a function of said electrical signal, wherein the louder the volume of sound received by said audio detector, the more current said current flow controller directs to said variable speed motor and the faster said variable speed motor rotates.

8. The assembly according to claim 7, wherein said assembly is a toy having at least one mechanism powered by said motor, wherein said audio detector, said motor and said current flow controller are all contained within said toy.

9. The assembly according to claim 7, wherein said assembly includes a toy having at least one mechanism powered by said motor and a separate handset that contains said audio detector, wherein said audio detector communicates said electrical signal to said toy via a remote link.

10. The assembly according to claim 7, further including an amplifier disposed between said audio detector and said current flow controller for amplifying the amplitude of the electrical signal produced by the audio detector.

11. The assembly according to claim 10, wherein said electrical signal produced by said audio detector is an alternating current signal, and said assembly includes a rectifier disposed between said amplifier and said current flow controller for converting the electrical signal into a direct current signal.

12. The assembly according to claim 11, further including a filter for filtering said direct current signal.

13. The assembly according to claim 7, wherein said current flow controller is a transistor, wherein said electrical signal is received by the gate of the transistor.

14. A method of controlling the rotating speed of a variable speed motor used to power a toy vehicle, said method comprising the steps of:

converting sound energy into a corresponding electrical signal, wherein said electrical signal varies with the volume of the sound energy;

utilizing said electrical signal to selectively adjust a current flow controller, wherein said current flow controller enables the flow of current in a manner proportional to the volume of sound energy represented by said electrical signal; and directing current through said current flow controller to said variable speed motor, wherein the louder the sound energy received, the more current said current flow controller directs to said variable speed motor, the faster said variable speed motor rotates and the faster said toy vehicle travels.

15. The method according to claim 14, wherein said step of converting sound energy into a corresponding electrical signal includes detecting the sound energy with a microphone, wherein the microphone converts the sound energy into said electrical signal.

16. The method according to claim 14, further including the step of amplifying said electrical signal prior to utilizing said electrical signal to selectively adjust the current flow controller.

17. The method according to claim 14, further including the step of rectifying said electrical signal prior to utilizing said electrical signal to selectively adjust the current flow controller.

18. The method according to claim 17, further including the step of filtering said electrical signal prior to utilizing said electrical signal to selectively adjust the current flow controller.

* * * * *